US008074375B2

(12) United States Patent
Longuet

(10) Patent No.: US 8,074,375 B2
(45) Date of Patent: Dec. 13, 2011

(54) BOOT

(75) Inventor: Marc Longuet, Menilhubert sur Orne (FR)

(73) Assignee: Le Chameau (FR)

( * ) Notice: Subject to any disclaimer, the term of this patent is extended or adjusted under 35 U.S.C. 154(b) by 486 days.

(21) Appl. No.: 12/404,847

(22) Filed: Mar. 16, 2009

(65) Prior Publication Data

US 2010/0229429 A1 Sep. 16, 2010

(51) Int. Cl.
*A43B 1/04* (2006.01)
*A43B 7/06* (2006.01)
*A43B 23/07* (2006.01)

(52) U.S. Cl. ..... 36/3 R; 36/55; 36/4

(58) Field of Classification Search ..... 36/3 R, 36/3 A, 3 B, 4, 45, 55
See application file for complete search history.

(56) References Cited

U.S. PATENT DOCUMENTS

| | | | | |
|---|---|---|---|---|
| 7,219,448 | B2 * | 5/2007 | Cheng | 36/44 |
| 2005/0034330 | A1 * | 2/2005 | Baychar | 36/55 |
| 2010/0031532 | A1 * | 2/2010 | Bass | 36/44 |
| 2011/0162130 | A1 * | 7/2011 | Courvoisier | 2/243.1 |

FOREIGN PATENT DOCUMENTS

EP 2070431 A1 * 6/2009

* cited by examiner

*Primary Examiner* — Marie Patterson
(74) *Attorney, Agent, or Firm* — Cantor Colburn LLP

(57) ABSTRACT

The invention relates to a boot (1) comprising a leg (2) in rubber combined with a textile lining (4), the lining (4) comprising a first textile layer (6) able to evacuate moisture (10) and a second textile layer (7) intended to be in contact with the foot (5) of a user, forming a layer to protect the foot against moisture. The first textile layer (6) is made by using a resilient fabric with a thickness greater than 3 mm, and the second textile layer (7) is bamboo viscose based.

7 Claims, 2 Drawing Sheets

BOOT

FIELD OF THE INVENTION

The invention relates to a boot, more particularly a boot of the type comprising a rubber leg combined with a textile lining.

BACKGROUND OF THE INVENTION

A boot generally comprises a lining in order to increase the user's comfort. Considering the fact that the leg is made of an impermeable material, the user's foot sweats and sweat tends to accumulate in the boot.

Moisture thus generally accumulates in the textile lining, which is uncomfortable for the user.

In order to remedy this disadvantage, document U.S. Pat. No. 4,430,811 proposes a boot in which the lining comprises a first textile layer that is able to evacuate moisture and a second textile lining intended to be in contact with the user's foot, forming a layer to protect the foot against moisture.

As the first layer has a thin thickness, an intermediate layer of foam must be inserted between the textile lining and the rubber leg in order to increase the user's comfort, which increases the complexity of the boot.

In addition, because of its thin thickness, the first layer tends to be progressively crushed after long periods of use of the boot, such that the moisture evacuation function is no longer properly ensured.

Lastly, the material used to make the second layer does not sufficiently protect the foot against moisture.

BRIEF DESCRIPTION OF THE INVENTION

The invention aims to remedy these disadvantages by proposing a boot that is not very complex and that increases the user's comfort.

For this purpose, the invention relates to a boot of the aforementioned type, characterized in that the first textile layer is made by using a resilient fabric with a thickness greater than 3 mm, and the second textile layer is bamboo viscose based.

The thickness of the first layer allows the layer to preserve its resilient character, even after a long period of use, so as to ensure good evacuation of moisture. Such a thickness provides sufficient comfort to the user, such that an additional foam layer is no longer needed.

In addition, bamboo viscose, in combination with the first aforementioned layer, ensures good protection of the foot of the user against moisture. This type of material also retains its properties after having been subjected to high temperatures. This guarantees that the second layer is not damaged during the boot manufacturing process, the process conventionally comprising a step for vulcanizing the rubber leg.

According to one characteristic of the invention, the first textile layer is polyester based.

Advantageously, the first textile layer is present in the form of a thick circular knitted fabric comprising a front face and a rear face, the two faces being interconnected by an intermediate layer made by using a connecting mono filament.

According to one possibility of the invention, the monofilament is made of polyester and presents a fineness of 100 dtex.

Preferentially, the thickness of the first textile layer is on the order of 4.3 mm.

According to one characteristic of the invention, the second layer is made of a plush loop textile.

This type of textile has a high capacity to absorb moisture and transfer it to the first layer for evacuation.

In particular, the absorption capacity of the first aforementioned layer is four times greater than that of a conventional textile lining in cotton.

Advantageously, the second textile layer is comprised of approximately 60% bamboo viscose and approximately 40% cotton.

BRIEF DESCRIPTION OF THE FIGURES

In any case, the invention will be clearly understood from the following description, with reference to the attached schematic drawing representing, in a non-limiting example, a form of embodiment of this boot.

DETAILED DESCRIPTION OF THE PREFERRED EMBODIMENTS

Figure 1:
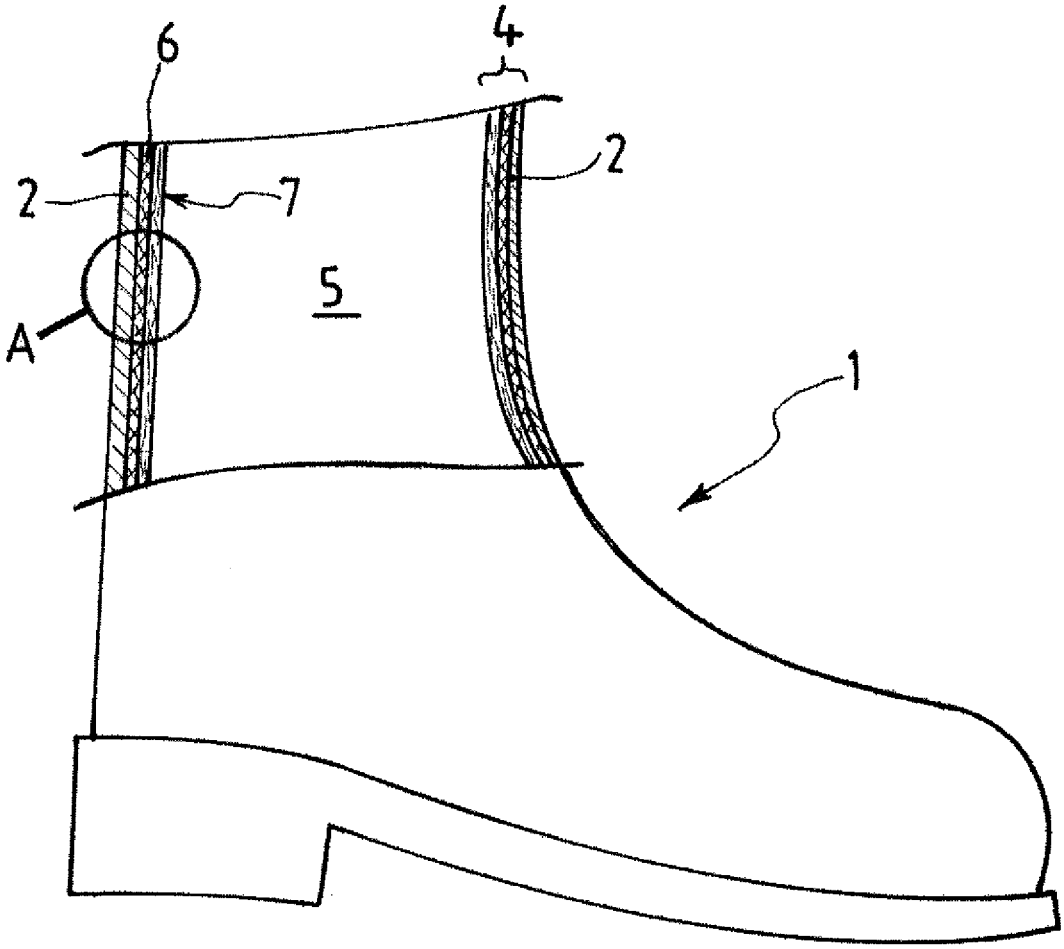
FIG. 1 is a partial cross sectional view.
Figure 2:
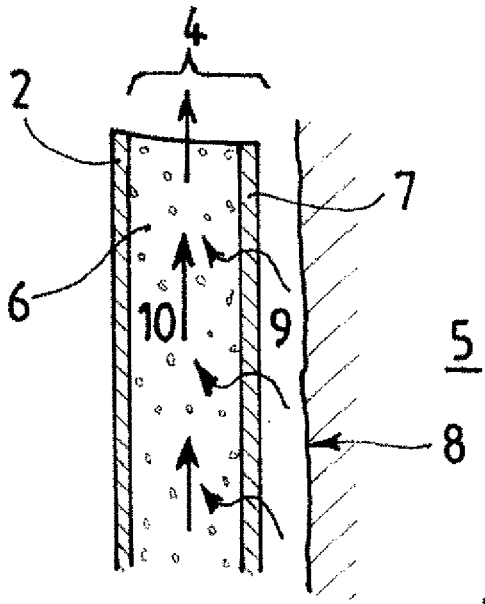
FIG. 2 is an enlarged view of zone A from FIG. 1.

A boot 1 according to the invention is represented in FIG. 1. The boot comprises a leg 2 connected to a sole 3.

Leg 2 is impermeable and is made of natural vulcanized rubber. The thickness of leg 2 is between 16 and 35 mm.

In addition, the leg comprises a lateral adjustment zone presenting an opening 11 defining a border 12 to which a gusset 13 is attached. Gusset 13 is flexible and covers the aforementioned opening 11.

A clamp 14 is also fixed on the leg 2, the clamp allowing the opposite edges of opening 11 to be brought together, if necessary, so as to be able to properly tighten the top part of leg 1, which accentuates the user's comfort.

A textile lining 4 is attached to the leg, on the inside 5 of boot 1.

This textile lining 4 comprises a first textile layer 6 formed from a fabric of the type as that described in document WO 01/68963.

This first textile layer 6 is made of polyester and is present in the form of a thick, 3-dimensional circular knitted fabric, comprising a front face and a rear face, the two faces being interconnected by an intermediate layer made by using a connection monofilament in fused polyester. The fineness of the monofilament is on the order of 100 dtex.

The first layer 6 is made by circular knitting.

The thickness of the first textile layer 6 is greater than 3 mm, preferably on the order of 4.3 mm.

Until then, using this type of textile had never been considered for making boots, but only for making car seats, as indicated in document WO 01/68963, with different functions from those described below.

Lining 4 also presents a second textile layer 7, situated on the inner surface of the first textile layer 6.

The second layer 7 is comprised of approximately 60% bamboo viscose and approximately 40% combed cotton, this also being made in a plush loop textile.

In order to assemble the lining to the leg so as to produce a finished product all in one piece, lining 4 undergoes an operation known as latexing. During this operation, the first textile layer 6 is coated with liquid rubber. The thickness of the coated latex layer is on the order of 0.05 mm; this layer must be sufficiently thin so as to not clog the first textile layer 6 with latex, which would affect the breathability properties of this layer and, more generally, of the boot.

Figure 3:
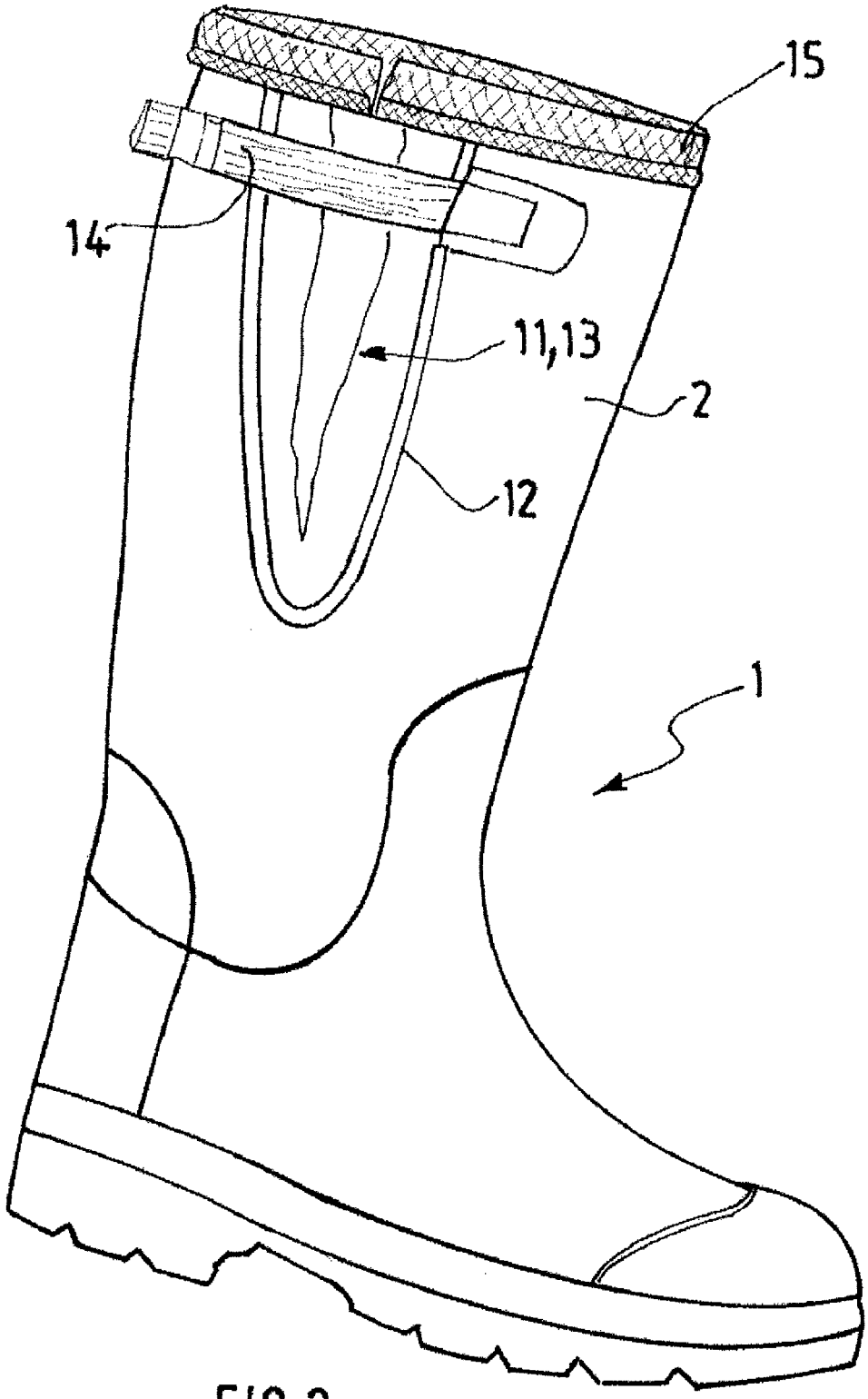
FIG. 3 is a perspective view of the boot.

As represented in FIG. 3, the upper end of the lining 4 is extended by a border 15 folded on the upper end of leg 2.

Border 15 is made from a textile material presenting a plurality of openings, so as to facilitate the evacuation of moist air.

The properties of boot 1 will now be detailed.

During use, the sweat from the foot 8 of the user enters into contact with the second textile layer 7. The layer has high moisture absorption and transfer properties, such that the moisture or sweat 9 inside boot 1 rapidly traverses the second layer 7 until it reaches the first layer 6.

The moist and hot air then progressively rises upwards inside the first textile layer 6, as represented by arrow 10, in the direction of the top of boot 1 leg, so as to evacuate the moisture across border 15. The circulation of moist air is facilitated by the significant thickness of the first textile layer 6 and by the space made within this layer by using 3-dimensional type circular knitting.

In addition, this evacuation is facilitated by natural convection movements due to the fact that the moist air is warmer than the outer air, and by the pumping effect caused during walking. In fact, during walking, foot 8 of the user regularly compresses the lining 4, and in particular the first textile layer 6, such that the moist air that it contains is necessarily evacuated in the direction of the open end. The first textile layer 6 thus plays the role of a shaft promoting the rapid extraction of moist air.

In addition, the elastic properties of the first layer 6 also allow the user's comfort to be increased.

Furthermore, by transferring moisture to the first layer 6, the second layer 7 in bamboo viscose enables the foot 8 of the user to be kept dry, thus also increasing the user's comfort.

It goes without saying that the invention is not limited to the single form of embodiment of this combination, described above by way of example, but, on the contrary, the invention covers all variations.

The invention claimed is:

1. A boot comprising a leg in rubber combined with a textile lining, the lining comprising a first textile layer able to allow moisture to be evacuated and a second textile layer intended to be in contact with a foot of a user, forming a layer to protect the foot against moisture, wherein the first textile layer is made by using a resilient fabric with a thickness greater than 3 mm and the second textile layer is bamboo viscose based.

2. The boot according to claim 1, wherein the first textile layer is polyester based.

3. The boot according to claim 1, wherein the first textile layer is a thick circular knitted fabric comprising a front face and a rear face, the two faces being interconnected by an intermediate layer made by using a connecting monofilament.

4. The boot according to claim 3, wherein the monofilament is made of polyester and presents a fineness of 100 dtex.

5. The boot according to claim 1, wherein a thickness of the first textile layer is on the order of 4.3 mm.

6. The boot according to claim 1, wherein the second layer is made of a plush loop textile.

7. The boot according to claim 1, wherein the second textile layer is comprised of approximately 60% bamboo viscose and approximately 40% cotton.

* * * * *